US011976464B2

(12) United States Patent
Blehm et al.

(10) Patent No.: US 11,976,464 B2
(45) Date of Patent: May 7, 2024

(54) BASE ASSEMBLY FOR A PREFABRICATED WALL SYSTEM

(71) Applicant: DIRTT ENVIRONMENTAL SOLUTIONS LTD., Calgary (CA)

(72) Inventors: Colin V. Blehm, Calgary (CA); Patrick J. Harris, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 211 days.

(21) Appl. No.: 17/437,704

(22) PCT Filed: Jun. 10, 2020

(86) PCT No.: PCT/US2020/036946

§ 371 (c)(1),
(2) Date: Sep. 9, 2021

(87) PCT Pub. No.: WO2020/251985

PCT Pub. Date: Dec. 17, 2020

(65) Prior Publication Data

US 2022/0127847 A1 Apr. 28, 2022

Related U.S. Application Data

(60) Provisional application No. 62/859,417, filed on Jun. 10, 2019.

(51) Int. Cl.
*E04B 2/82* (2006.01)
*E04B 2/74* (2006.01)

(52) U.S. Cl.
CPC ..... *E04B 2/821* (2013.01); *E04B 2/7401* (2013.01); *E04B 2002/7492* (2013.01)

(58) Field of Classification Search
CPC . E04B 2/7401; E04B 2/821; E04B 2002/7492
(Continued)

(56) References Cited

U.S. PATENT DOCUMENTS 9,982,431 B2 * 5/2018 Del Missier ..... E04B 2/7448
2010/0242378 A1 * 9/2010 Cifelli ..... E04B 2/821 52/126.6

(Continued)

FOREIGN PATENT DOCUMENTS

DE 1913292 A1 * 9/1970
GB 2520925 A * 6/2015 ..... E04B 2/7401
WO 2018/185679 10/2018

OTHER PUBLICATIONS

International Preliminary Report on Patentability received for PCT Patent Application No. PCT/US2020/036946, dated Dec. 23, 2021, 14 pages.

(Continued)

*Primary Examiner* — Christine T Cajilig
(74) *Attorney, Agent, or Firm* — Workman Nydegger

(57) ABSTRACT

A base assembly of a prefabricated wall system includes a base extrusion, a base track, and a leveling assembly. The base extrusion includes an upper channel that is at least partially defined by first and second vertical members, and the upper channel is configured to receive an edge of a prefabricated wall panel. The base extrusion includes a lower channel opposite to the upper channel. An opening of the upper channel and an opening of the lower channel are oriented in opposite directions. The base track comprises a base track channel configured to affix to a floor of a building. The leveling assembly is configured to reside within both the lower channel of the base extrusion and the base track channel of the base track. The leveling assembly is adjustable to adjust a vertical position of the base extrusion with respect to the base track.

20 Claims, 7 Drawing Sheets

(58) Field of Classification Search
USPC ..... 52/126.4
See application file for complete search history.

(56) References Cited

U.S. PATENT DOCUMENTS

| | | | | |
|---|---|---|---|---|
| 2013/0192141 | A1* | 8/2013 | Kopish | E05D 15/063 49/413 |
| 2015/0204070 | A1* | 7/2015 | Gierens | F21V 33/006 52/28 |
| 2018/0045363 | A1* | 2/2018 | Mitrovic | E04B 2/7401 |
| 2019/0177973 | A1* | 6/2019 | Mitrovic | E04B 2/7401 |
| 2019/0234078 | A1* | 8/2019 | McDonald | E04B 2/7448 |

OTHER PUBLICATIONS

International Search Report and Written Opinion for PCT/US2020/036946 dated Nov. 12, 2020.
Office Action received for European Patent Application No. 20751352.4, dated Jul. 18, 2023, 7 pages.

* cited by examiner

BASE ASSEMBLY FOR A PREFABRICATED WALL SYSTEM

CROSS-REFERENCE TO RELATED APPLICATIONS

This application is a 371 US nationalization of PCT Patent Application No. PCT/US2020/036946, filed Jun. 10, 2020, which claims priority to U.S. provisional patent application No. 62/859,417, filed Jun. 10, 2019. The entire content of the aforementioned patent applications is incorporated herein by reference.

BACKGROUND

Office space can be relatively expensive, not only due to the basic costs of the location and size of the office space, but also due to any construction needed to configure the office space in a particular way. Furthermore, as an organization's needs change, it is often necessary to have a convenient and efficient means to reconfigure the existing office space rather than having to move to a new office space. For example, interior office space is sometimes partitioned into smaller areas, such as conference rooms, offices, cubicles, and the like. Furthermore, other interior spaces (e.g., residential spaces) can be divided into partitions for various purposes.

Interior spaces can be divided utilizing prefabricated wall systems (e.g., modular wall systems) that include one or more prefabricated wall modules. The prefabricated wall modules can be arranged/secured adjacent to one another to form interior partitions, such as office cubicles, rooms, etc. The prefabricated wall modules can affix to ceiling and floor connection components (e.g., ceiling track(s) and floor/base track(s)) to provide stable partitioning walls. Many organizations address their configuration and reconfiguration issues by dividing large, open office spaces into individual work areas using prefabricated wall systems.

Many interior spaces, however, lack a uniformly level floor upon which prefabricated wall systems can rest. Consequently, some prefabricated wall systems implement leveling apparatuses to enable leveling of the prefabricated wall modules within the prefabricated wall system.

Conventional leveling apparatuses for prefabricated wall systems are often large and/or unsightly. To hide such leveling apparatuses from view, some prefabricated wall systems conceal such leveling apparatuses in between wall panels of prefabricated wall modules. Accordingly, many prefabricated wall systems that include thin wall modules (e.g., with wall panels that are close in proximity to provide a sleek aesthetic) and/or single-substrate wall modules (e.g., glass panel modules) fail to accommodate conventional leveling apparatuses for prefabricated wall systems.

In addition, the unevenness of a floor and/or ceiling can necessitate different leveling configurations for adjacent prefabricated wall modules in a prefabricated wall system. Such variations between adjacent prefabricated wall modules can cause the adjacent prefabricated wall modules to interface with the ceiling and/or floor connection components at different heights, resulting in an unappealing aesthetic.

Furthermore, many prefabricated wall systems include doors, such as hinge, pivot, and/or sliding doors. Pivot doors in prefabricated wall systems often include a pivot door rail that is screwed into the door panel(s) of the pivot door. However, conventional pivot door assemblies can be unsuitable for single-substrate door panels composed of hard and/or brittle materials (e.g., glass door panels). For example, during use, forces exerted on a door panel from a pivot positioned within a hole of the door panel may crack a door panel that is composed of hard and/or brittle material.

Accordingly, there are a number of difficulties associated with components for prefabricated wall systems that can be addressed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Implementations of the present disclosure extend to systems, apparatuses, and components for forming, assembling, and installing components for a prefabricated wall system with single-substrate wall panels. More specifically, the present disclosure relates to prefabricated wall system leveling assemblies and pivot door assemblies that are suitable for prefabricated wall systems that include single-substrate prefabricated wall panels.

For example, at least one embodiment comprises a base assembly that includes a base extrusion, a base track, and a leveling assembly configured to reside within both the base track and the base extrusion. In at least another embodiment, a prefabricated wall system includes a single-substrate prefabricated wall panel, a base assembly, and a top assembly that includes a ceiling track, trim elements, and retainer wipes. In at least another embodiment, a pivot door assembly for a single-substrate prefabricated panel includes first and second half channels, a pivot door receiver, and a pivot door rail.

The embodiments disclosed and claimed herein can provide prefabricated wall systems with single-substrate prefabricated wall panels in an advantageous manner. For instance, the leveling assemblies of the base assemblies of the present disclosure can compactly reside below a prefabricated wall module and above a base track, rather than between wall panels of a prefabricated wall module. In addition, the pivot door assemblies of the present disclosure can affix to single-substrate door panels of a prefabricated wall system without creating holes in the single-substrate door panel.

For example, a base assembly of a prefabricated wall system can comprise a base extrusion, a base track, and a leveling assembly. The base extrusion can include an upper channel that is at least partially defined by first and second vertical members, and the upper channel can be configured to receive an edge of a prefabricated wall panel. The base extrusion can also include a lower channel opposite to the upper channel. An opening of the upper channel and an opening of the lower channel can be oriented in opposite directions.

The base track can comprise a base track channel, and the base track can be configured to affix to a floor of a building. The leveling assembly can be configured to reside within both the lower channel of the base extrusion and the base track channel of the base track. The leveling assembly can be adjustable to adjust a vertical position of the base extrusion with respect to the base track.

In another example, a prefabricated wall system can comprise a single-substrate prefabricated wall panel that has a top end and a bottom end. The prefabricated wall system can also include a base assembly and a top assembly. The base assembly can comprise a base extrusion, a base track, and a leveling assembly.

The base extrusion can include an upper channel that is at least partially defined by first and second vertical members, and the upper channel can be configured to receive an edge of a prefabricated wall panel. The base extrusion can also include a lower channel opposite to the upper channel. An opening of the upper channel and an opening of the lower channel can be oriented in opposite directions.

The base track can comprise a base track channel, and the base track can be configured to affix to a floor of a building. The leveling assembly can be configured to reside within both the lower channel of the base extrusion and the base track channel of the base track. The leveling assembly can be adjustable to adjust a vertical position of the base extrusion with respect to the base track.

The top assembly can comprise a ceiling track that has first and second ceiling trim elements and first and second retainer wipes. The first and second ceiling trim elements can extend downward from opposing lateral sides of the ceiling track, and the first and second ceiling trim elements can form a ceiling track channel. The first and second retainer wipes can extend inward, respectively, from the first and second ceiling trim elements. The top end of the single-substrate prefabricated wall panel can be configured to reside between the first and second retainer wipes within the ceiling track channel.

In yet another example, a pivot door assembly for a single-substrate prefabricated panel of a prefabricated wall system can comprise a first half channel configured to affix to a first surface of a bottom portion of the single-substrate prefabricated panel and at least partially cover a bottom edge of the single-substrate prefabricated panel. The pivot door assembly can also comprise a second half channel configured to affix to a second surface of the bottom portion of the single-substrate prefabricated panel and at least partially cover the bottom edge of the single-substrate prefabricated panel.

The pivot door assembly can also comprise a pivot door rail. The pivot door rail can include an upward-facing channel configured to receive the bottom portion of the single-substrate prefabricated panel and the first and second half channels when the first and second half channels are affixed to the bottom portion of the single-substrate prefabricated panel. Channel walls of the upward-facing channel can include inward protrusions for retaining the first and second half channels within the upward-facing channel.

The pivot door rail can also include a downward-facing channel configured to house a pivot door receiver. The pivot door receiver can include a hole configured to receive a pivot.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be apparent to one of ordinary skill in the art from the description, or may be learned by the practice of the teachings herein. Features and advantages of embodiments described herein may be realized and obtained by means of the instruments and combinations particularly pointed out in the appended claims. Features of the embodiments described herein will become more fully apparent from the following description and appended claims.

BRIEF DESCRIPTION OF THE DRAWINGS

To further clarify the above and other features of the embodiments described herein, a more particular description will be rendered by reference to the appended drawings. It is appreciated that these drawings depict only examples of the embodiments described herein and are therefore not to be considered limiting of its scope. The embodiments will be described and explained with additional specificity and detail through the use of the accompanying drawings in which.

DETAILED DESCRIPTION

Implementations of the present disclosure extend to systems, apparatuses, and components for forming, assembling, and installing components for a prefabricated wall system with single-substrate wall panels. More specifically, the present disclosure relates to prefabricated wall system leveling assemblies and pivot door assemblies that are suitable for prefabricated wall systems that include single-substrate prefabricated wall panels.

For example, at least one embodiment comprises a base assembly that includes a base extrusion, a base track, and a leveling assembly configured to reside within both the base track and the base extrusion. In at least another embodiment, a prefabricated wall system includes a single-substrate prefabricated wall panel, a base assembly, and a top assembly that includes a ceiling track, trim elements, and retainer wipes. In at least another embodiment, a pivot door assembly for a single-substrate prefabricated panel includes first and second half channels, a pivot door receiver, and a pivot door rail.

The embodiments disclosed and claimed herein can provide prefabricated wall systems with single-substrate prefabricated wall panels in an advantageous manner. For instance, conventional leveling assemblies reside between opposing wall panels of a prefabricated wall module, necessitating relatively thick prefabricated wall modules to accommodate conventional leveling assemblies. In contrast, at least some leveling assemblies of the present disclosure can compactly reside below a prefabricated wall module and above a base track, while still being concealed from view. Accordingly, at least some leveling assemblies of the present disclosure can be implemented into prefabricated wall systems that include thin prefabricated wall modules, such as those with single-substrate prefabricated wall panels (e.g., glass panels).

In addition, conventional pivot door assemblies for prefabricated wall systems include a pivot door rail that is screwed to the door panel of the pivot door, which can be unsuitable for door panels that are composed of hard and/or brittle materials (e.g., single-substrate door panels, such as glass door panels). At least some pivot door assemblies of the present disclosure can affix to door panels of a prefabricated wall system without creating holes in the door panel. Accordingly, at least some of the pivot door assemblies of the present disclosure can be implemented into prefabricated wall systems that include single-substrate door panels composed of hard and/or brittle materials (e.g., glass door panels).

Figure 1:
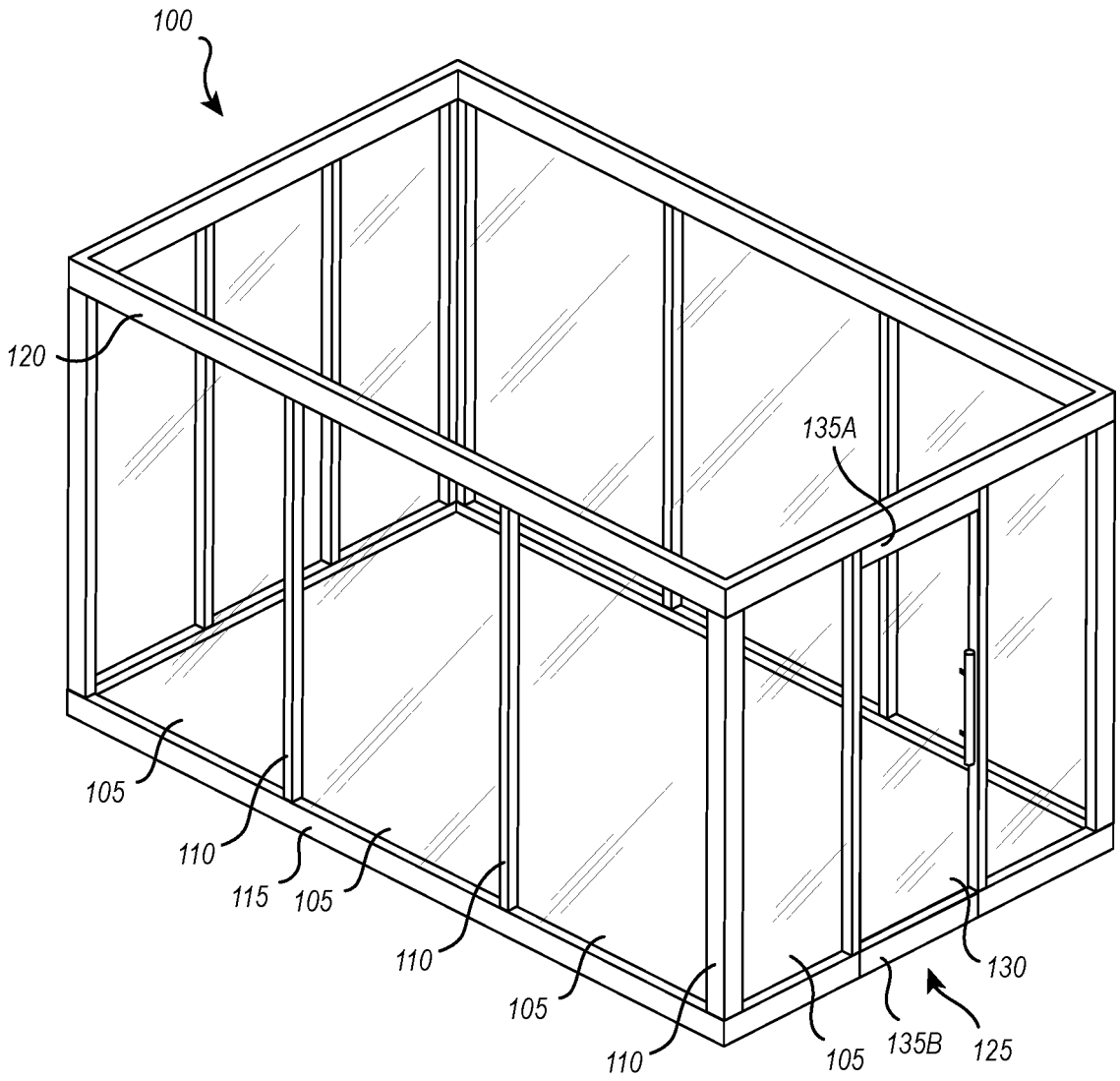
FIG. 1 illustrates a perspective view of a prefabricated wall system, in accordance with implementations of the present disclosure.

FIG. 1 illustrates a perspective view of an example of a prefabricated wall system 100. The prefabricated wall system 100 of FIG. 1 includes a plurality of prefabricated wall panels 105. FIG. 1 illustrates that the prefabricated wall panels 105 are arranged within the prefabricated wall system 100 to form a partitioning configuration (e.g., for an interior space of a building).

In some implementations, one or more of the prefabricated wall panels 105 comprise single-substrate panels, such as glass or polymer panels (see FIG. 1). Although the present disclosure focuses, in some respects, on prefabricated wall panels 105 that include a single-substrate panel, it should be noted that the configuration of a prefabricated wall panel of the present disclosure can be varied. For example, a prefabricated wall panel 105 can comprise of any rigid material and need not be transparent or translucent. Furthermore, in some implementations, a prefabricated wall panel 105 comprises multiple panels offset from one another to form a space therebetween.

FIG. 1 shows that the prefabricated wall panels 105 can affix to vertical structural components 110, base assemblies 115, and top assemblies 120 within the prefabricated wall system 100. In some implementations, the base assemblies 115 and/or the top assemblies 120 are configured to provide leveling functionality to accommodate uneven floors and/or ceilings of installation spaces for a prefabricated wall system 100.

FIG. 1 also illustrates a pivot door 125 of a prefabricated wall system 100. The pivot door 125 of FIG. 1 includes a door panel 130 and pivot assemblies 135A, 135B to facilitate the pivoting functionality of the pivot door 125. In some implementations, the pivot assemblies 135A, 135B affix to the door panel 130 without forming holes within the door panel 130 (e.g., without screws).

In some instances, the door panel 130 can comprise the same material as the prefabricated wall panels 105. In other instances, the door panel 130 and the prefabricated wall panels 105 of a prefabricated wall system 100 comprise different materials. For example, one or more of the wall panels 105 of a prefabricated wall system 100 can comprise glass, while the door panel 130 of a prefabricated wall system can comprise a polymer substrate.

Figure 2A:
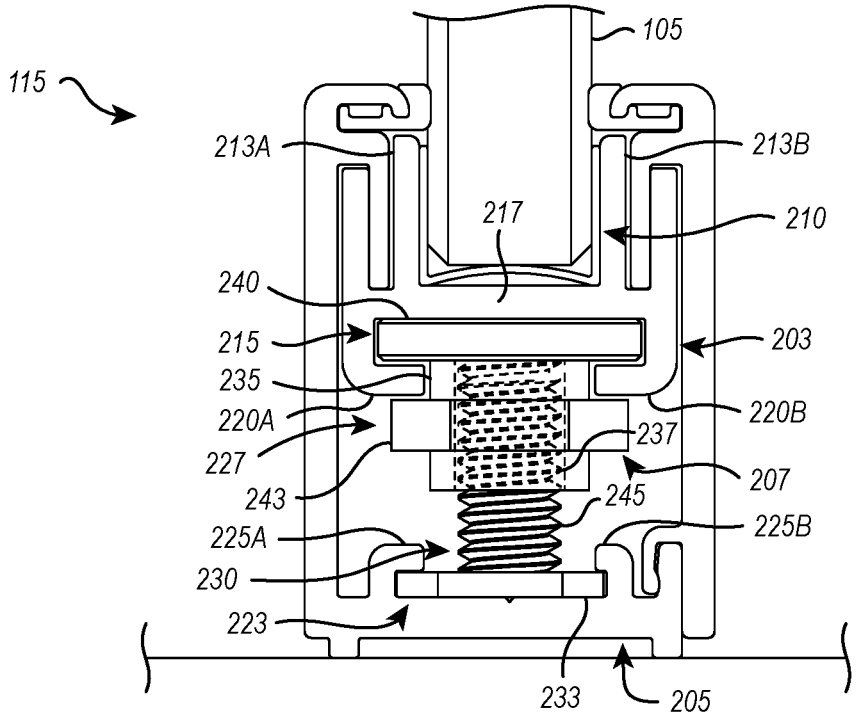
FIG. 2A illustrates an end view of a prefabricated wall system base assembly in a raised configuration, in accordance with implementations of the present disclosure.

FIG. 2A illustrates an end view of a base assembly 115 of a prefabricated wall system 100. FIG. 2A shows that the base assembly 115 can include various components, such as a base extrusion 203, a base track 205, and a leveling assembly 207. The various components of the base assembly 115 described herein can enable the base assembly 115 to provide leveling functionality in a compact manner, without disrupting the aesthetic of a prefabricated wall system 100.

FIG. 2A illustrates that the base extrusion 203 can include an upper channel 210 defined by vertical members 213A and 213B. FIG. 2A shows that the upper channel 210 can be configured to receive a bottom edge of a prefabricated wall panel 105. The bottom edge of the prefabricated wall panel 105 can secure to the base extrusion 203 within the upper channel 210 by any method known in the art (e.g., friction fit). The base extrusion 203 may intervene between the bottom edge of the prefabricated wall panel 105 and the leveling assembly 207 to distribute the force exerted by the leveling assembly 207 on the prefabricated wall panel 105.

FIG. 2A also illustrates that the base extrusion 203 can also include a lower channel 215. FIG. 2A shows that the lower channel 215 can be arranged opposite to the upper channel 210. For example, the opening of the upper channel 210 and the opening of the lower channel 215 can be oriented in opposite directions.

In addition, FIG. 2A depicts an implementation in which both the upper channel 210 and the lower channel 215 share a channel wall 217 that intervenes between the upper channel and the lower channel. The shared channel wall 217 between the upper channel 210 and the lower channel 215 can enable the base extrusion 203 to have a vertically compact structure, which can enable the base assembly 115 to provide leveling functionality in a vertically compact manner (e.g., allowing the leveling assembly 207 to reside below the prefabricated wall panel 105 in the prefabricated wall system 100).

FIG. 2A furthermore illustrates that the lower channel 215 of the base extrusion 203 can include inward protrusions 220A, 220B for retaining a portion of the leveling assembly 207 within the lower channel 215 (e.g., for retaining the anchor protrusion 240 of the leveling collar 227 of the leveling assembly 207, as discussed in more detail below).

The base track 205 of the base assembly 115 illustrated in FIG. 2A can affix to a floor of an installation space and provide a support to other components of a prefabricated wall system 100 (e.g., prefabricated wall panels 105). FIG. 2A shows that the base track 205 can include a base track channel 223 that may include inward protrusions 225A, 225B for retaining a portion of the leveling assembly 207 within the base track channel 223 (e.g., for retaining the leveling base 233 of the leveling assembly 207, as discussed in more detail below).

The leveling assembly 207 of the base assembly 115 shown in FIG. 2A can be configured to reside within both the lower channel 215 of the base extrusion 203 and the base track channel 223 of the base track 205 (e.g., with the anchor protrusion 240 of the leveling collar 227 within the lower channel 215 and with the leveling base 233 within the base track channel 223).

The leveling assembly 207 can be adjustable to provide a raised configuration (illustrated in FIG. 2A), a lowered configuration (illustrated in FIG. 2B), and/or any configuration therebetween. In this regard, the leveling assembly can be operable to adjust the leveling of a prefabricated wall panel 105 within a prefabricated wall system 100 to accommodate unevenness of the floor and/or ceiling of an installation space.

FIG. 2A furthermore illustrates that the leveling assembly 207 of the base assembly 115 can include various components that can facilitate the adjustment/leveling functionality of the leveling assembly 207. For example, the leveling assembly 207 can include a leveling collar 227, a leveling stud 230, and a leveling base 233.

FIG. 2A shows that the leveling base 233 of the leveling assembly 207 can be configured to reside within the base track channel 223 of the base track 205 and retained within the base track channel 223 by the inward protrusions 225A, 225B of the base track channel 223. The leveling base 233 can comprise any suitable shape, such as a rectangular, hexagonal, trapezoidal, and/or other shape.

FIG. 2A illustrates that the leveling stud 230 of the leveling assembly 207 can include a threaded body 245. The threads of the threaded body 245 can correspond to interior threads of the threaded opening 237 of the leveling collar 227. The leveling stud 230 can also be affixed to the leveling base 233. For example, a screw can extend through an underside of the base track 205 and through the leveling base 233 into a threaded opening (not shown) of the leveling stud 230. Other affixation methods are within the scope of this disclosure, such as welding, integrally forming the leveling stud 230 with the leveling base 233, threading the threaded body 245 (or another threaded portion) of the leveling stud 230 through a corresponding threaded opening of the leveling base 233, etc.

FIG. 2A shows that the leveling collar 227 can include a collar body 235 that defines a threaded opening 237 that extends at least partially through the leveling collar 227. The threaded opening 237 can include interior threads that correspond to the threads of the threaded body 245 of the leveling stud 230. Accordingly, the leveling collar 227 can thread about the leveling stud 230 to adjust a leveling height of the leveling collar 227, base extrusion 203, and prefabricated wall panel 105 with respect to the base track 205 (and the floor of an installation space to which the base track 205 may be attached).

The leveling collar 227 may also include an anchor protrusion 240 that extends radially from the collar body 235. The anchor protrusion 240 can be configured to reside within the lower channel 215 of the base extrusion 203 and be retained within the lower channel 215 by the inward protrusions 220A, 220B of the lower channel 215.

Those skilled in the art will recognize, in view of the present disclosure, that the anchor protrusion 240 can take on various forms in various implementations. For example, the anchor protrusion 240 can comprise a substantially annular radial protrusion, and/or can include any other suitable shape. Furthermore, the anchor protrusion 240 can comprise any number of radial protrusions extending away from the collar body 235 (e.g., two, three, four, or more radial protrusions).

FIG. 2A furthermore illustrates that the leveling collar can include a tool interface 243 disposed on the collar body 235 offset from the anchor protrusion 240. The tool interface 243 may at least partially surround the leveling collar 227 and can provide an engagement interface for interfacing with a tool. Although the tool interface 243 can be implemented in various forms, FIG. 2A illustrates the tool interface as a hexagonal interface.

Thus, in some instances, a user can operate a tool (e.g., a wrench) to engage with the tool interface 243 of the leveling collar 227 to rotate the leveling collar 227 about the leveling stud 230, thereby adjusting the relative positioning of the leveling collar 227 and the leveling stud 230 (e.g., by advancing or retracting the leveling collar 227 along the leveling stud 230 via the corresponding threads). For example, as noted above, FIG. 2B illustrates an implementation in which the leveling collar 227 has rotated about the leveling stud 230 to bring the leveling assembly 207 into a lowered configuration.

Figure 2B:
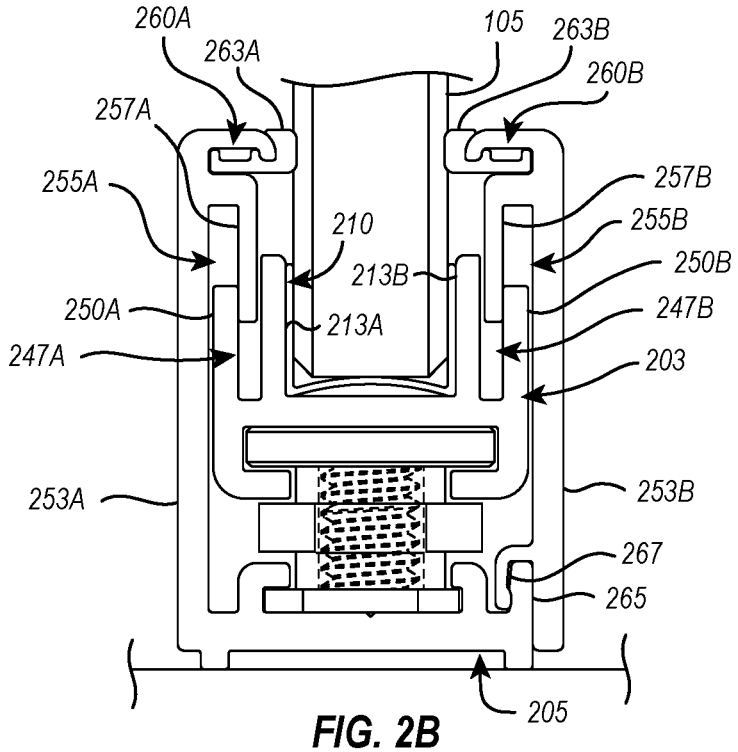
FIG. 2B illustrates an end view of a prefabricated wall system base assembly in a lowered configuration, in accordance with implementations of the present disclosure.

FIG. 2B (and FIG. 2A) illustrates additional details concerning the base assembly 115. For example, FIG. 2B illustrates that the base extrusion 203 can include a first lateral side channel 247A and a second lateral side channel 247B disposed on opposite lateral sides of the upper channel 210 of the base extrusion 203.

The first and second lateral side channels 247A, 247B can be at least partially defined, respectively, by the vertical members 213A, 213B that define the upper channel 210 of the base extrusion 203 and by additional vertical members 250A, 250B of the base extrusion 203. For instance, FIG. 2B illustrates the first lateral side channel 247A defined by vertical member 213A and additional vertical member 250A. FIG. 2B also illustrates the second lateral side channel 247B defined by vertical member 213B and additional vertical member 250B. In some instances, the vertical members 213A, 213B have a height that is greater than that of the additional vertical members 250A, 250B.

FIG. 2B furthermore, illustrates that the base track 205 can include first and second trim elements 253A, 253B extending upward from opposing lateral sides of the base track 205. The trim elements 253A, 253B can operate to conceal the leveling assembly 207 from view and/or to provide a smooth base aesthetic for a prefabricated wall system 100.

FIG. 2B also shows that the first and second trim elements 253A, 253B can each comprise an engagement channel 255A, 255B. Engagement channel 255A is at least partially defined by engagement member 257A, and engagement channel 255B is at least partially defined by engagement member 257B. Engagement channel 255A can be configured to adjustably engage with the first lateral side channel 247A of the base extrusion 203, and engagement channel 255B can be configured to adjustably engage with the second lateral side channel 247B of the base extrusion 203.

For example, FIG. 2B illustrates that the first lateral side channel 247A can adjustably receive engagement member 257A, and engagement channel 255A can adjustably receive additional vertical member 250A, such that the first lateral side channel 247A and engagement channel 255A interlock with one another. Similarly, FIG. 2B illustrates that the second lateral side channel 247B can adjustably receive engagement member 257B, and engagement channel 255B can adjustably receive additional vertical member 250B, such that the second lateral side channel 247B and engagement channel 255B interlock with one another.

In at least some implementations, a user can adjust the engagement between the first and second engagement channels 255A, 255B of the first and second trim elements 253A, 253B and the first and second lateral side channels 247A, 247B by adjusting the leveling assembly 207 (e.g., by rotating the leveling collar 227 about the leveling stud 230).

For example, FIG. 2A demonstrates that engagement members 257A and 257B advance, respectively, into the first lateral side channel 247A and the second lateral side channel 247A as a user adjusts the leveling assembly 207 into a raised configuration. Similarly, FIG. 2B demonstrates that engagement members 257A and 257B retract, respectively, from the first lateral side channel 247A and the second lateral side channel 247A as a user adjusts the leveling assembly 207 into a lowered configuration.

One will appreciate, in view of the present disclosure, that the first and second trim elements 253A, 253B and the first and second lateral side channels 247A, 247B may remain engaged with one another regardless of the leveling configuration of the leveling assembly 207. In this regard, in some instances, the height of the first and second lateral side channels 247A, 247B corresponds to the leveling range of the leveling assembly 207. Accordingly, in some instances, the base assemblies 115 of the present disclosure may provide a consistent base aesthetic regardless of the unevenness of a floor of an installation space.

FIG. 2B also illustrates that, in some instances, the first and second trim elements 253A, 253B can each comprise a seal channel 260A, 260B that is configured to receive and secure a respective seal 263A, 263B. In some instances, the seal channels 260A and 260B are each formed, respectively, at least partially by engagement members 257A and 257B and by overhang lips associated with the first and second trim elements 253A, 253B.

When installed in the seal channels 260A, 260B, the seals 263A, 263B can be configured to abut opposing surfaces of the prefabricated wall panel 105 arranged within the upper channel 210 of the base extrusion 203. The seals 263A, 263B may prevent dust and/or debris from entering the base assembly 115 and may also prevent contact between the first and second trim elements 253A, 253B and the prefabricated wall panel 105 (e.g., to protect a glass prefabricated wall panel 105 from contact with metal trim elements 253A, 253B).

FIG. 2B further illustrates that, in some instances, a trim element of a base track 205, such as second trim element 253B, is selectively removable from the base track 205. FIG. 2B shows that the base track 205 can include a vertical element 265 on a second lateral side thereof and that the second trim element 253B can comprise a connection element 267 that can selectively engage with the vertical element 265.

In some instances, the second trim element 253B can be selectively removed from the base track 205 by disengaging the connection element 267 from the vertical element 265 and by disengaging engagement channel 255B of the second trim element 253B from the second lateral side channel 247B of the base extrusion 203. For instance, FIG. 3 illustrates the second trim element 253B selectively removed from the base track 205.

Figure 3:
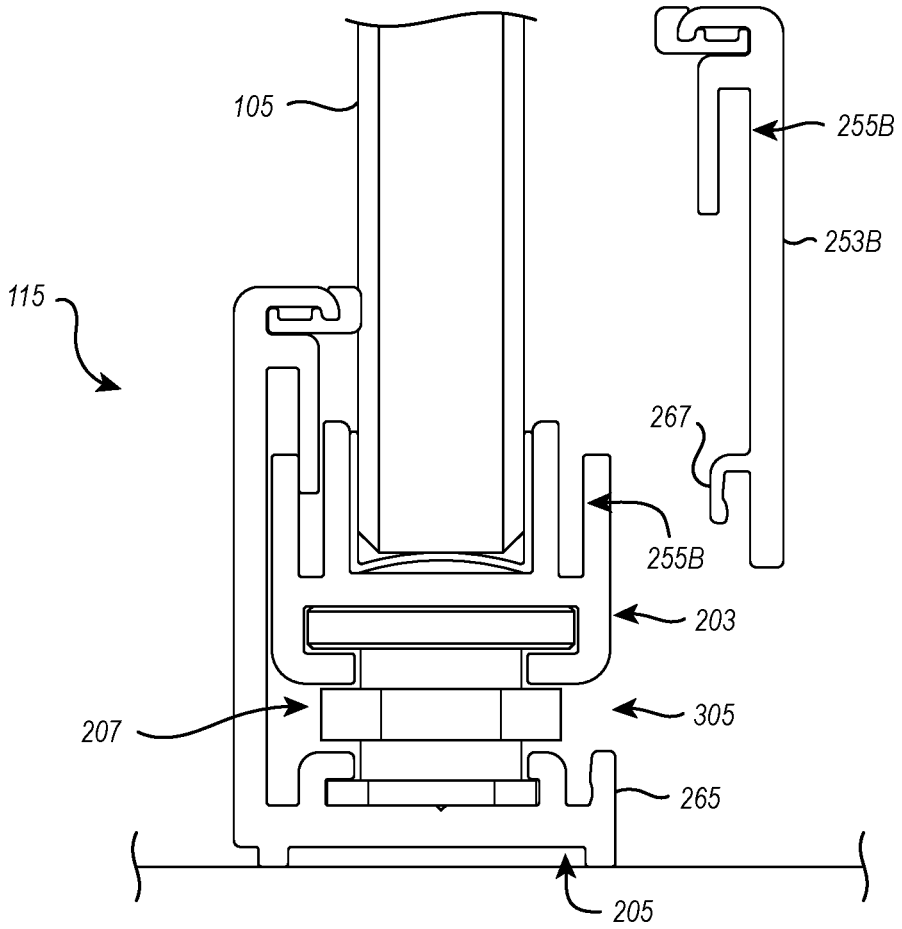
FIG. 3 illustrates an end view of a prefabricated wall system base assembly with a trim element selectively removed therefrom, in accordance with implementations of the present disclosure.

In some instances, providing a selectively removable trim element may provide access to the leveling assembly 207 to enable adjustment of the leveling assembly 207 when the leveling assembly 207 is arranged between the base track 205 and the base extrusion 203, as indicated in FIG. 3 by arrow 305.

Although FIGS. 2A-3 illustrate implementations in which only one trim element is selectively removable from the base track 205, those skilled in the art will appreciate, in view of the present disclosure, that both trim elements of a base track 205 may be selectively removable therefrom in some implementations.

Those skilled in the art will recognize, in view of the present disclosure, that a prefabricated wall panel 105 in a prefabricated wall system 100 can include any number of leveling assemblies 207 positioned thereunder. For example, a base extrusion 203 that receives a single prefabricated wall panel 105 can interface with a first leveling assembly 207 proximate to one end of the base extrusion 203 and with a second leveling assembly 207 proximate to a second end of the base extrusion 203. As such, in some instances, a user can adjust a leveling height of a prefabricated wall panel 105 on two separate ends of the prefabricated wall panel 105.

Furthermore, those skilled in the art will recognize, in view of the present disclosure, that various components of a base assembly 115 can be configured to interface with any number of prefabricated wall panels 105. For example, in some implementations, a prefabricated wall system 100 can include a base track 205 that spans multiple adjacently arranged prefabricated wall panels 105. In such implementations, the first and second trim elements 253A, 253B of the base track 205 (and the seals 263A, 263B) may provide a continuous base aesthetic across multiple adjacently arranged prefabricated wall panels 105.

In addition, in some implementations, a prefabricated wall system 100 can include a separate base extrusion 203 and/or one or more separate leveling assemblies 207 for at least some of the prefabricated wall panel 105 within the prefabricated wall system 100. In some instances, providing one base extrusion 203 and/or one or more separate leveling assembles 207 for each prefabricated wall panel 105 in a prefabricated wall system 100 enables customized leveling for each prefabricated wall panel 105 of the prefabricated wall system, which can accommodate unevenness variations throughout an installation space.

Furthermore, multiple base extrusions 203 and leveling assemblies 207 of multiple prefabricated wall panels 105 can interface with the same base track 205. Accordingly, the benefits of per-panel leveling and a continuous base aesthetic may, in at least some instances, be realized simultaneously.

Figure 4:
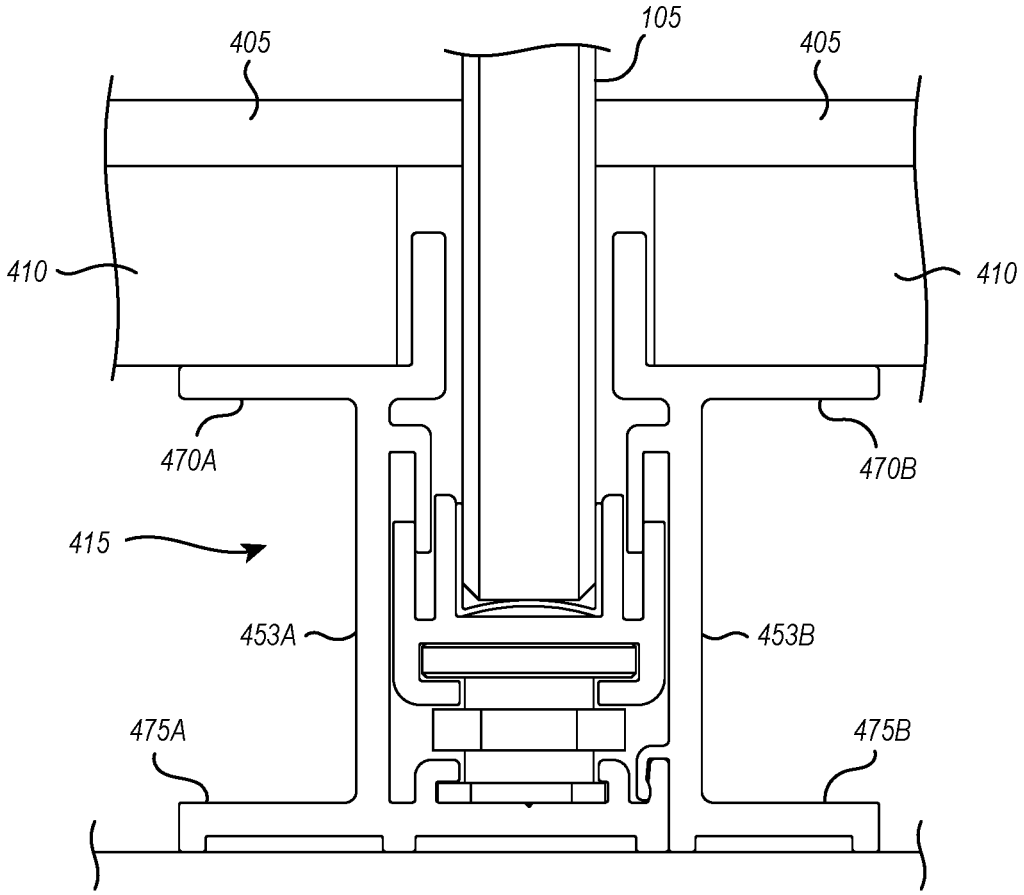
FIG. 4 illustrates an end view of a sub-floor configuration of a prefabricated wall system base assembly, in accordance with implementations of the present disclosure.

In some implementations, a base assembly of the present disclosure can be configured to complement a subfloor of an installation space, such that a floor covering of an installation space may substantially abut a prefabricated wall panel 105 to provide a desirable aesthetic. FIG. 4 illustrates an end view of a sub-floor configuration of a prefabricated wall system base assembly 415 in which a floor covering 405 of an installation space substantially abuts the prefabricated wall panel 105. In many respects, the base assembly 415 is similar to the base assembly 115 described hereinabove with reference to FIGS. 1-3.

FIG. 4 illustrates that the base assembly 415 may include first and second trim elements 453A and 453B. FIG. 4 shows that the first and second trim elements 453A and 453B can each include a cantilever extension 470A, 470B that forms a shelf that is configured to support a floor base 410. The first and second trim elements 453A and 453B may also include, respectively, additional base supports 475A and 475B extending from bottom portions of the first and second trim elements 453A and 453B to support the additional weight introduced by the floor base 410.

Figure 5A:
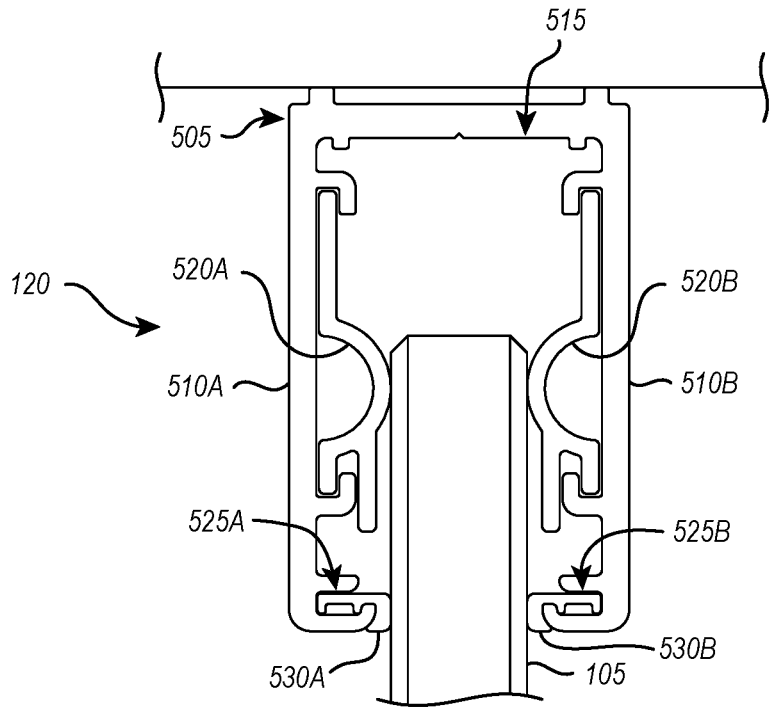
FIG. 5A illustrates an end view of a prefabricated wall system top assembly in a lowered configuration, in accordance with implementations of the present disclosure.
Figure 5B:
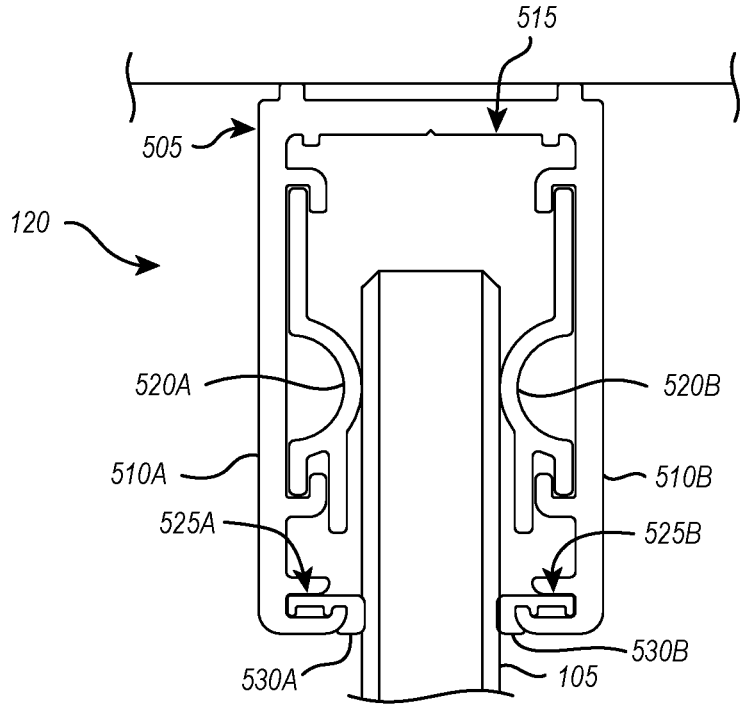
FIG. 5B illustrates an end view of a prefabricated wall system top assembly in an intermediate configuration, in accordance with implementations of the present disclosure.
Figure 5C:
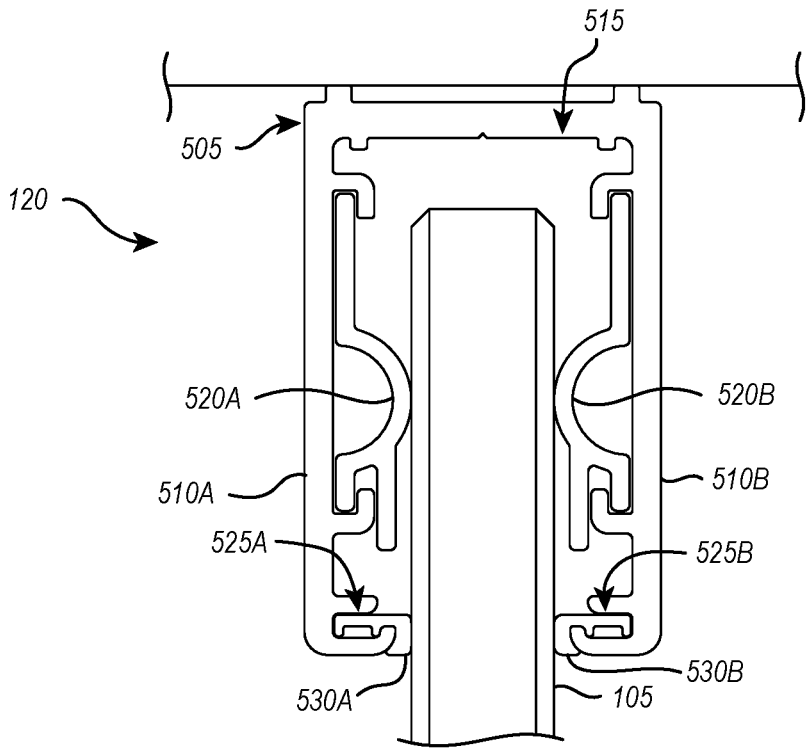
FIG. 5C illustrates an end view of a prefabricated wall system top assembly in a raised configuration, in accordance with implementations of the present disclosure.

FIGS. 5A-5C illustrate end views of a prefabricated wall system top assembly 120 in various configurations. In some implementations, the top assemblies 120 of a prefabricated wall system of the present disclosure can accommodate different leveling configurations of the leveling assembly 207 of the base assembly 115.

For example, FIG. 5A illustrates an end view of a top assembly 120 when the leveling assembly 207 is in a lowered configuration. FIG. 5A illustrates that the top assembly 120 can include a ceiling track 505 configured to affix to a ceiling of a building. FIG. 5A shows that the ceiling track 505 can at least partially receive and retain the prefabricated wall panel 105 within a prefabricated wall system 100.

The ceiling track 505 of the top assembly 120 can comprise a first ceiling trim element 510A and a second ceiling trim element 510B. FIG. 5A illustrates that the first ceiling trim element 510A and the second ceiling trim element 510B are on opposing lateral sides of the ceiling track 505. FIG. 5A also illustrates that the first and second ceiling trim elements 510A and 510B form a ceiling track channel 515 that is configured to at least partially receive the prefabricated wall panel 105.

FIG. 5A furthermore shows that the top assembly 120 can include a first retainer wipe 520A and a second retainer wipe 520B that extend inward, respectively, from the first ceiling trim element 510A and the second ceiling trim element 510B. The top end of the prefabricated wall panel 105 can be configured to reside between the first retainer wipe 520A and the second retainer wipe 520B within the ceiling track channel 515 of the prefabricated wall system 100.

FIGS. 5A-5C illustrate that the positioning of the top end of the prefabricated wall panel 105 between the first and second retainer wipes 520A and 520B within the ceiling track channel 515 can be adjusted by adjusting the leveling assembly 207 of the base assembly 115 (see FIGS. 2A-2B). For example, in some instances, the positioning of the top end of the prefabricated wall panel 105 within the ceiling track channel 515 can be adjusted by rotating the leveling collar 227 about the leveling stud 230 (e.g., via a tool interacting with tool interface 243) while the bottom end of the prefabricated wall panel 105 is arranged within the upper channel 210 of the base extrusion 203 and the top end of the prefabricated wall panel 105 is arranged between the first retainer wipe 520A and the second retainer wipe 520B.

FIG. 5A shows the positioning of the top end of the prefabricated wall panel 105 within the ceiling track channel 515 when the leveling assembly 207 is in a lowered configuration (e.g., according to FIG. 2B). FIG. 5B shows the positioning of the top end of the prefabricated wall panel 105 within the ceiling track channel 515 when the leveling assembly 207 is in an intermediate leveling configuration (e.g., between a lowered and a raised configuration). In some instances, the top end of the prefabricated wall panel 105 can advance into the ceiling track channel 515 as the leveling assembly 207 is raised (e.g., by elevating the leveling collar 227 with respect to the leveling base 233, see FIGS. 2A and 2B).

FIG. 5C shows the positioning of the top end of the prefabricated wall panel 105 within the ceiling track channel 515 when the leveling assembly is in a raised configuration (e.g., according to FIG. 2A).

Accordingly, FIGS. 5A-5C demonstrate that the top assembly 120 can retain the top end of the prefabricated wall panel 105 whether the leveling assembly 207 is adjusted to a raised configuration (illustrated in FIG. 2A), a lowered configuration (illustrated in FIG. 2B), and/or any configuration therebetween. In this regard, in some instances, the distance between the top portion of the ceiling track and the retainer wipes (i.e., the first retainer wipe 520A and the second retainer wipe 520B) corresponds to the leveling range of the leveling assembly.

FIGS. 5A-5C illustrate the first and second retainer wipes 520A and 520B as extrusions that are separate, respectively, from the first ceiling trim element 510A and the second ceiling trim element 510B but are connected, respectively, to the first ceiling trim element 510A and the second ceiling trim element 510B (e.g., via engagement of interlocking features). However, those skilled in the art will recognize, in view of the present disclosure, that the top assembly can comprise any number of extrusions. For instance, in some implementations, the first and second trim elements 510A and 510B and the first and second retainer wipes 520A and 520B can all be part of the same extrusion.

FIGS. 5A-5C also illustrate that, in some instances, the first and second ceiling trim elements 510A, 510B each comprise a top seal channel 525A, 525B that is configured to receive and secure a respective top seal 530A, 530B. When installed in the top seal channels 525A, 525B, the top seals 530A, 530B can be configured to abut opposing surfaces of the prefabricated wall panel 105 arranged within the ceiling track channel 515 of the ceiling track 505. In some instances, the top seals 530A, 530B associated with the ceiling track 505 can comprise the same manufacture as the seals 263A, 263B associated with the base track 205, which can improve manufacturing efficiency.

One will appreciate, in view of the present disclosure, that the top seals 530A, 530B may differ from the seals 263A, 263B associated with the base track 205. For example, in some implementations, the top seals 530A and 530B may be configured to reside within and extend downward from top seal channels that are implemented into the first and second retainer wipes 520A and 520B, respectively (e.g., rather than or in addition to the top seal channels 525A and 525B of the first and second ceiling trim elements 510A and 510B illustrated in FIGS. 5A-5C).

Figure 6:
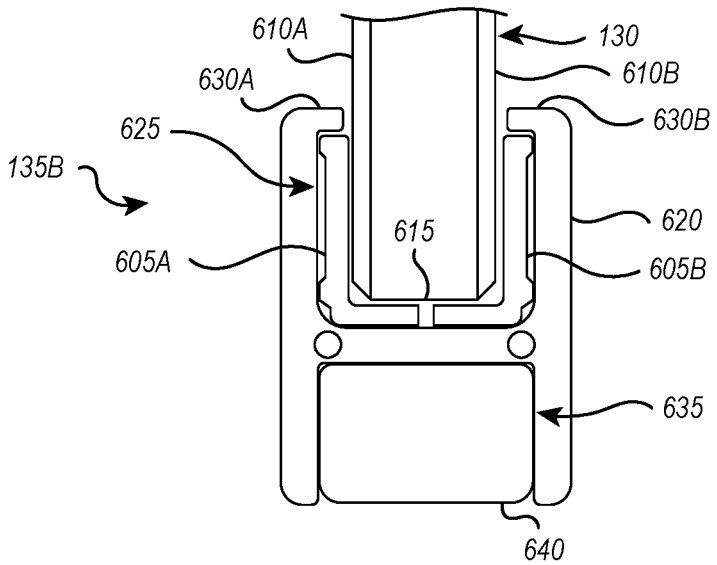
FIG. 6 illustrates an end view of a pivot assembly for a pivot door of a prefabricated wall system, in accordance with implementations of the present disclosure.

FIG. 6 illustrates an end view of a pivot assembly 135B for a pivot door 125 of a prefabricated wall system 100 (see FIG. 1). The pivot door 125 can include a door panel 130 that comprises, for example, a single-substrate panel (e.g., a glass panel). In some instances, the door panel 130 comprises a brittle material that is unsuited for receiving a pivot within one or more holes formed within the door panel 130 (e.g., a glass panel).

FIG. 6 illustrates that the pivot door assembly 135B can include a first half channel 605A that can be configured to affix to a first surface 610A of the bottom portion of the door panel 130. The first half channel 605A can also be configured to at least partially cover a bottom edge 615 of the door panel when the first half channel 605A is affixed to the first surface 610A of the door panel 130. Similarly, FIG. 6 shows that the pivot door assembly 135B can include a second half channel 605B that can be configured to affix to a second surface 610B of the bottom portion of the door panel 130. The second half channel 605B can also be configured to at least partially cover the bottom edge 615 of the door panel when the second half channel 605B is affixed to the second surface 610B of the door panel 130.

FIG. 6 also illustrates that the pivot door assembly 135B can comprise a pivot door rail 620. The pivot door rail 620 can include an upward-facing channel 625 that can be configured to receive the bottom portion of the door panel 130 (e.g., including the bottom edge 615). The upward-facing channel 625 can also be configured to receive the first and second half channels 605A and 605B.

For example, a user may slide the bottom portion of the door panel 130, with the first and second half channels 605A and 605B affixed thereto, into the upward-facing channel 625 through an end of the upward-facing channel 625. FIG. 6 illustrates that channel walls of the upward-facing channel 625 may include inward protrusions 630A and 630B to retain the first and second half channels 605A and 605B within the upward-facing channel 625.

FIG. 6 furthermore demonstrates that the pivot door rail 620 may include a downward-facing channel 635 that is arranged opposite to the upward-facing channel 625. For example, the opening of the upward-facing channel 625 and the opening of the downward-facing channel 635 can be oriented in opposite directions. The downward-facing channel 635 can be configured to house a pivot door receiver 640.

Figure 7:
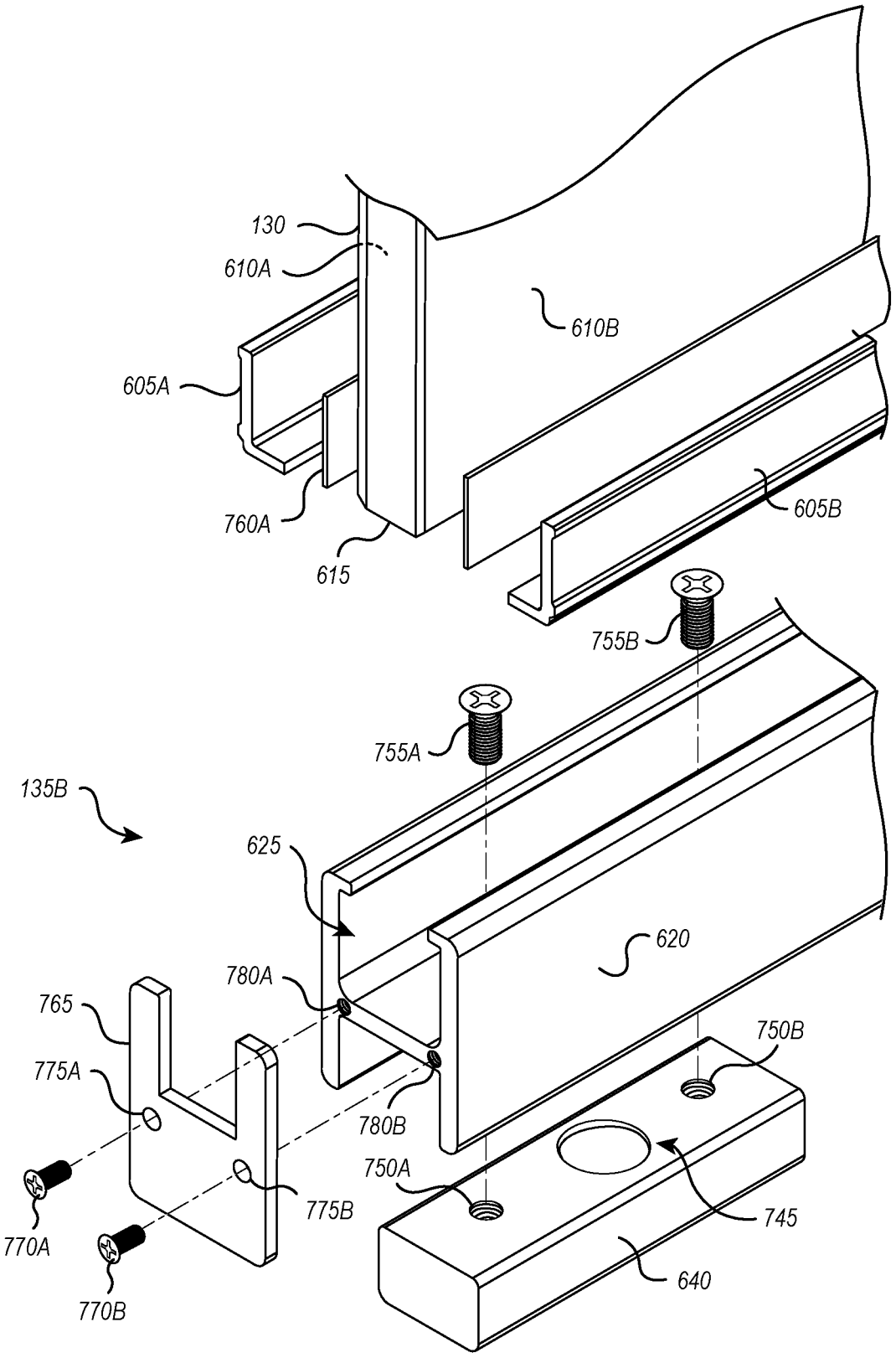
FIG. 7 illustrates an exploded view of a pivot door assembly for a prefabricated wall system, in accordance with implementations of the present disclosure.

FIG. 7 illustrates an exploded view of a pivot door assembly 135B for a pivot door 125 of a prefabricated wall system 100. FIG. 7 shows that the pivot door receiver 640 can comprise a hole 745 that can be configured to receive a pivot to facilitate the pivot functionality of the pivot door 125. FIG. 7 also illustrates that the pivot door receiver 640 can also include threaded holes 750A, 750B for receiving screws 755A, 755B that may advance through holes in the pivot door rail 620 into the threaded holes 750A, 750B to secure the pivot door receiver 640 to the pivot door rail 620. Other attachment mechanisms aside from screws are within the scope of this disclosure (e.g., a single screw, welding, being formed as a single part, adhesives, interference fit, interlocking members, etc.).

FIG. 7 further illustrates that, in some instances, the first half channel 605A can be configured to affix to the first surface 610A of the door panel 130 with a tape adhesive 760A. Similarly, FIG. 7 illustrates that the second half channel 605B can be configured to affix to the second surface 610B of the door panel 130 with a tape adhesive 760B (e.g., a high bond tape adhesive). Other adhesives known in the art may also be used to secure the first and second half channels 605A, 605B to the first and second surfaces 610A, 610B of the door panel 130.

In addition, FIG. 7 shows that a pivot door rail 620 of a pivot door assembly 135B may include an end cap 765 that can affix to an end of the pivot door rail 620. By way of non-limiting example, an end cap 765 may affix to the pivot door rail 620 via screws 770A and 770B passing through holes 775A and 775B in the end cap and threading into holes 780A and 780B of the end portion of the pivot door rail 620. The end cap 765 may prevent the bottom portion of the door panel 130 and/or the first and second half channels 605A, 605B from exiting the upward-facing channel 625 of the pivot door rail 620 after being installed therein. One will appreciate, in view of the present disclosure, that a pivot door rail 620 can include any number of end caps and/or components thereof.

In this regard, at least some pivot door assemblies of the present disclosure (e.g., pivot door assembly 135B) provide a pivot door receiver (e.g., pivot door receiver 640) that receives a pivot in a compact manner that omits holes (e.g., threaded holes) in the bottom portion of the door panel (e.g., door panel 130).

In some embodiments, the first and second half channels 605A, 605B comprise the pivot door rail 620. For example, in some embodiments, the pivot door rail can be implemented in separate halves, with one half being configured to affix (e.g., with adhesives) to the first surface 610A of the door panel 130 and with the other half being configured to affix to the second surface 610B of the door panel 130. The two halves may both affix to the pivot door receiver 640 and one or more end caps 765 (e.g., with screws).

Those skilled in the art will recognize, in view of the present disclosure, that the principles disclosed herein with reference to pivot assembly 135B may also be applicable, in at least some instances, to a top pivot assembly, such as pivot assembly 135A (see FIG. 1).

Although, in various instances, the present disclosure states singular elements (e.g., a base extrusion, a leveling assembly) and/or plural elements (e.g., pivot assemblies, vertical members), those skilled in the art will appreciate, in view of the present disclosure, that one or more of any of the elements described herein can be used according to the present disclosure.

Those skilled in the art will recognize, in view of the present disclosure, that any denotations of first, second, front, back, top, bottom etc. (e.g., top assembly, bottom portion, first lateral side channel, second trim element, etc.) in the present disclosure can be somewhat arbitrary and are provided for illustrative purposes and/or for ease of description. Thus, any ordinal and/or other denotations included herein are in no way limiting of the present disclosure. One will appreciate that any other denotations not explicitly included herein are within the scope of this disclosure.

The foregoing description and Figures illustrate features, properties, details, implementations, and variations of components for a prefabricated wall system with single-substrate (or otherwise thin) wall panels. One will appreciate, in view of the present disclosure, that various embodiments of components for a prefabricated wall system with single-substrate (or otherwise thin) wall panels, can include any combination of the various features, properties, details, etc. described hereinabove.

In a first embodiment, a base assembly 115 for a prefabricated wall system 100 includes a base extrusion 203. The base extrusion 203 includes an upper channel 210 at least partially defined by first and second vertical members 213A and 213B. The upper channel 210 is configured to receive an edge of a prefabricated wall panel 105. The base extrusion 203 also includes a lower channel 215 opposite to the upper channel 210, wherein an opening of the upper channel 210 and an opening of the lower channel 215 are oriented in opposite directions.

The base assembly 115 also includes a base track 205 comprising a base track channel 223. The base track 205 is configured to affix to a floor of a building. The base assembly 115 also includes a leveling assembly 207 configured to reside within both the lower channel 215 of the base extrusion 203 and the base track channel 223 of the base track 205. The leveling assembly 207 is adjustable to adjust a vertical position of the base extrusion 203 with respect to the base track 205.

In a second embodiment, the base assembly corresponds to the base assembly of the first embodiment, and the leveling assembly includes a leveling collar. The leveling collar comprises a collar body that defines a threaded opening extending at least partially through the leveling collar, an anchor protrusion extending from the collar body and configured to reside within the lower channel of the base extrusion, and a tool interface disposed on the collar body offset from the anchor protrusion and configured to interface with a tool.

The leveling assembly also includes a leveling stud comprising a threaded body with threads that correspond to threads of the threaded opening of the leveling collar, and a leveling base affixed to the leveling stud, the leveling base being configured to reside within the base track channel.

In a third embodiment, the base assembly corresponds to the base assembly of the second embodiment, and the lower channel comprises inward protrusions for retaining the anchor protrusion of the leveling assembly within the lower channel.

In a fourth embodiment, the base assembly corresponds to the base assembly of the second embodiment, and the base track channel comprises inward protrusions for retaining the leveling base within the base track channel.

In a fifth embodiment, the base assembly corresponds to the base assembly of any one of the first, second, third, or fourth embodiment, and the upper channel and the lower channel of the base extrusion share a channel wall that intervenes between the upper channel and the lower channel.

In a sixth embodiment, the base assembly corresponds to the base assembly of any one of the first, second, third, fourth, or fifth embodiment, and the base extrusion includes first and second lateral side channels disposed on opposite lateral sides of the upper channel. The first lateral side channel is at least partially defined by the first vertical member and a third vertical member of the base extrusion, and the second lateral side channel is at least partially defined by the second vertical member and a fourth vertical member of the base extrusion.

In a seventh embodiment, the base assembly corresponds to the base assembly of the sixth embodiment, and the first vertical member and the second vertical member have a height that is greater than a height of the third vertical member and the fourth vertical member.

In an eighth embodiment, the base assembly corresponds to the base assembly of the sixth or seventh embodiment, and a height of the first and second lateral side channels corresponds to a leveling range of the leveling assembly.

In a ninth embodiment, the base assembly corresponds to the base assembly of any one of the first, second, third, fourth, fifth, sixth, seventh, or eighth embodiment, and the base track comprises first and second trim elements extending upward from opposing lateral sides of the base track.

In a tenth embodiment, the base assembly corresponds to the base assembly of the ninth embodiment, and the first and second trim elements each comprise a seal channel configured to house a respective seal. The respective seals, when installed in the seal channels, are configured to abut opposing surfaces of one or more prefabricated wall panels arranged within the upper channel of the base extrusion.

In an eleventh embodiment, the base assembly corresponds to the base assembly of the ninth or tenth embodiment, and the first and second trim elements each comprise engagement channels configure to adjustably engage with, respectively, first and second lateral side channels disposed on opposite lateral sides of the upper channel.

In a twelfth embodiment, the base assembly corresponds to the base assembly of the eleventh embodiment, and an engagement between the engagement channels of the first and second trim elements and the first and second lateral side channels of the upper channel is adjustable by adjusting the leveling assembly.

In a thirteenth embodiment the base assembly corresponds to the base assembly of the eleventh or twelfth embodiment, and the base track comprises a vertical element on a second lateral side of the base track channel. The second trim element comprises a connection element for selectively engaging with the vertical element on the second lateral side of the base track. Furthermore, the second trim element is selectively removable from the base track by disengaging the connection element of the second trim element from the vertical element of the base track and disengaging the engagement channel of the second trim element from the second lateral side channel of the base extrusion.

In a fourteenth embodiment, the base assembly corresponds to the base assembly of any one of the ninth, tenth, eleventh, twelfth, or thirteenth embodiment, and the first and second trim elements of the base track each comprise a cantilever extension extending laterally therefrom. The cantilever extension is configured to support a floor base.

In a fifteenth embodiment, the base assembly corresponds to the base assembly of any one of the first, second, third, fourth, fifth, sixth, seventh, eighth, ninth, tenth, eleventh, twelfth, thirteenth, or fourteenth embodiment, and the prefabricated wall panel is a single-substrate wall panel.

In a sixteenth embodiment, a prefabricated wall system 100 comprises a single-substrate prefabricated wall panel 105 that has a top end and a bottom end.

The prefabricated wall system 100 also includes a base assembly 115 that comprises a base extrusion 203. The base extrusion 203 includes an upper channel 210 at least partially defined by first and second vertical members 213A and 213B. The upper channel 210 is configured to receive an edge of a prefabricated wall panel 105. The base extrusion 203 also includes a lower channel 215 opposite to the upper channel 210, wherein an opening of the upper channel 210 and an opening of the lower channel 215 are oriented in opposite directions.

The base assembly 115 also includes a base track 205 comprising a base track channel 223. The base track 205 is configured to affix to a floor of a building. The base assembly 115 also includes a leveling assembly 207 configured to reside within both the lower channel 215 of the base extrusion 203 and the base track channel 223 of the base track 205. The leveling assembly 207 is adjustable to adjust a vertical position of the base extrusion 203 with respect to the base track 205.

The prefabricated wall system also includes a top assembly 120. The top assembly comprises a ceiling track 505 configured to affix to a ceiling of a building. The ceiling track 505 comprises first and second ceiling trim elements 510A, 510B extending downward from opposing lateral sides of the ceiling track 505, wherein the first and second ceiling trim elements 510A, 510B form a ceiling track channel 515. The ceiling track 505 also comprises first and second retainer wipes 520A, 520B extending inward, respectively, from the first and second ceiling trim elements 510A, 510B.

The top end of the single-substrate prefabricated wall panel 105 is configured to reside between the first and second retainer wipes 520A, 520B within the ceiling track channel 515.

In a seventeenth embodiment, the prefabricated wall system corresponds to the prefabricated wall system of the sixteenth embodiment, and the first and second ceiling trim elements each comprise a top seal channel configured to house a respective top seal. The respective top seals, when installed in the top seal channels, are configured to abut opposing surfaces of the single-substrate prefabricated wall panel when the top end of the single-substrate prefabricated wall panel is arranged between the retainer wipes within the ceiling track channel.

In an eighteenth embodiment, the prefabricated wall system corresponds to the prefabricated wall system of the sixteenth or seventeenth embodiment and a distance between a top portion of the ceiling track and the first and second retainer wipes corresponds to a leveling range of the leveling assembly.

In a nineteenth embodiment, a pivot door assembly 135A, 135B for a single-substrate prefabricated panel 130 of a prefabricated wall system 100 comprises a first half channel 605A configured to affix to a first surface 610A of a bottom portion of the single-substrate prefabricated panel 130 and at least partially cover a bottom edge 615 of the single-substrate prefabricated panel 130.

The pivot door assembly 135A, 135B also comprises a second half channel 605B configured to affix to a second surface 610B of the bottom portion of the single-substrate prefabricated panel 130 and at least partially cover the bottom edge 615 of the single-substrate prefabricated panel 130. The pivot door assembly 135A, 135B also includes a pivot door receiver 640 comprising a hole 745 configured to receive a pivot.

The pivot door assembly 135A, 135B also includes a pivot door rail 620 that comprises an upward-facing channel 625 configured to receive the bottom portion of the single-substrate prefabricated panel 130 and the first and second half channels 605A, 605B when the first and second half channels 605A, 605B are affixed to the bottom portion of the single-substrate prefabricated panel 130. Channel walls of the upward-facing channel 625 include inward protrusions 630A and 630B for retaining the first and second half channels 605A, 605B within the upward-facing channel 625.

The pivot door rail 620 also includes a downward-facing channel 635 configured to house the pivot door receiver 640.

In a twentieth embodiment, the pivot door assembly corresponds to the pivot door assembly of the nineteenth embodiment and the first and second half channels are configured to affix to the bottom portion of the single-substrate prefabricated wall panel with a tape adhesive.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

We claim:

1. A base assembly for a prefabricated wall system, the base assembly comprising:

a base extrusion, comprising:

an upper channel at least partially defined by first and second vertical members, the upper channel being configured to receive an edge of a prefabricated wall panel; and a lower channel opposite to the upper channel, wherein an opening of the upper channel and an opening of the lower channel are oriented in opposite directions, and wherein the lower channel comprises inward protrusions;

a base track comprising a base track channel, the base track being configured to affix to a floor of a building; and a leveling assembly configured to reside within both the lower channel of the base extrusion between the lower channel and the inward protrusions and the base track channel of the base track, wherein the leveling assembly is adjustable to adjust a vertical position of the base extrusion with respect to the base track.

2. The base assembly of claim 1, wherein the leveling assembly comprises:

a leveling collar, comprising:

a collar body defining a threaded opening extending at least partially through the leveling collar;

an anchor protrusion extending from the collar body and configured to reside within the lower channel of the base extrusion; and a tool interface disposed on the collar body offset from the anchor protrusion and configured to interface with a tool;

a leveling stud comprising a threaded body with threads that correspond to threads of the threaded opening of the leveling collar; and a leveling base affixed to the leveling stud, the leveling base being configured to reside within the base track channel.

3. The base assembly of claim 1, wherein the inward protrusions include a horizontal upper surface for retaining the anchor protrusion of the leveling assembly within the lower channel.

4. The base assembly of claim 2, wherein the base track channel comprises inward protrusions for retaining the leveling base within the base track channel.

5. The base assembly of claim 1, wherein the upper channel and the lower channel of the base extrusion share a channel wall that intervenes between the upper channel and the lower channel.

6. The base assembly of claim 1, wherein the base extrusion includes first and second lateral side channels disposed on opposite lateral sides of the upper channel, wherein:

the first lateral side channel is at least partially defined by the first vertical member and a third vertical member of the base extrusion, and the second lateral side channel is at least partially defined by the second vertical member and a fourth vertical member of the base extrusion.

7. The base assembly of claim 6, wherein the first vertical member and the second vertical member have a height that is greater than a height of the third vertical member and the fourth vertical member.

8. The base assembly of claim 6, wherein a height of the first and second lateral side channels corresponds to a leveling range of the leveling assembly.

9. The base assembly of claim 1, wherein the base track comprises first and second trim elements extending upward from opposing lateral sides of the base track.

10. The base assembly of claim 9, wherein:

the first and second trim elements each comprise a seal channel configured to house a respective seal, and the respective seals, when installed in the seal channels, are configured to abut opposing surfaces of one or more prefabricated wall panels arranged within the upper channel of the base extrusion.

11. The base assembly of claim 9, wherein the first and second trim elements each comprise engagement channels configure to adjustably engage with, respectively, first and second lateral side channels disposed on opposite lateral sides of the upper channel.

12. The base assembly of claim 11, wherein an engagement between the engagement channels of the first and second trim elements and the first and second lateral side channels of the upper channel is adjustable by adjusting the leveling assembly.

13. The base assembly of claim 11, wherein:

the base track comprises a vertical element on a second lateral side of the base track channel;

the second trim element comprises a connection element for selectively engaging with the vertical element on the second lateral side of the base track, and the second trim element is selectively removable from the base track by disengaging the connection element of the second trim element from the vertical element of the base track and disengaging the engagement channel of the second trim element from the second lateral side channel of the base extrusion.

14. The base assembly of claim 9, wherein the first and second trim elements of the base track each comprise a cantilever extension extending laterally therefrom, the cantilever extension being configured to support a floor base.

15. The base assembly of claim 1, wherein the prefabricated wall panel is a single-substrate wall panel.

16. A prefabricated wall system, comprising:

a single-substrate prefabricated wall panel, comprising a top end and a bottom end;

a base assembly, comprising:

a base extrusion, comprising:

an upper channel at least partially defined by first and second vertical members, the upper channel being configured to receive the bottom end of the single-substrate prefabricated wall panel;

a lower channel opposite to the upper channel, wherein an opening of the upper channel and an opening of the lower channel are oriented in opposite directions;

first and second lateral side channels disposed on opposite lateral sides of the upper channel;

wherein:

the first lateral side channel is at least partially defined by the first vertical member and a third vertical member of the base extrusion, the second lateral side channel is at least partially defined by the second vertical member and a fourth vertical member of the base extrusion; and the first vertical member and the second vertical member have a height that is greater than a height of the third vertical member and the fourth vertical member;

a base track comprising a base track channel, the base track being configured to affix to a floor of a building; and a leveling assembly configured to reside within both the lower channel of the base extrusion and the base track channel of the base track, wherein the leveling assembly is adjustable to adjust a vertical position of the base extrusion with respect to the base track; and a top assembly, comprising:

a ceiling track configured to affix to a ceiling of a building, the ceiling track comprising:

first and second ceiling trim elements extending downward from opposing lateral sides of the ceiling track, wherein the first and second ceiling trim elements form a ceiling track channel; and first and second retainer wipes extending inward, respectively, from the first and second ceiling trim elements, wherein:

the top end of the single-substrate prefabricated wall panel is configured to reside between the first and second retainer wipes within the ceiling track channel.

17. The prefabricated wall system of claim 16, wherein:

the first and second ceiling trim elements each comprise a top seal channel configured to house a respective top seal, and the respective top seals, when installed in the top seal channels, are configured to abut opposing surfaces of the single-substrate prefabricated wall panel when the top end of the single-substrate prefabricated wall panel is arranged between the retainer wipes within the ceiling track channel.

18. The prefabricated wall system of claim 16, wherein a distance between a top portion of the ceiling track and the first and second retainer wipes corresponds to a leveling range of the leveling assembly.

19. A pivot door assembly for a single-substrate prefabricated panel of a prefabricated wall system, the pivot door assembly comprising:

a first half channel configured to affix to a first surface of a bottom portion of the single-substrate prefabricated panel and at least partially cover a bottom edge of the single-substrate prefabricated panel;

a second half channel configured to affix to a second surface of the bottom portion of the single-substrate prefabricated panel and at least partially cover the bottom edge of the single-substrate prefabricated panel;

a pivot door receiver comprising a hole configured to receive a pivot; and a pivot door rail, comprising:

an upward-facing channel configured to receive the bottom portion of the single-substrate prefabricated panel and the first and second half channels when the first and second half channels are affixed to the bottom portion of the single-substrate prefabricated panel, wherein channel walls of the upward-facing channel include inward protrusions for retaining the first and second half channels within the upward-facing channel; and a downward-facing channel configured to house the pivot door receiver.

20. The pivot door assembly of claim 19, wherein the first and second half channels are configured to affix to the bottom portion of the single-substrate prefabricated wall panel with a tape adhesive.

* * * * *